US006052270A

United States Patent [19]

Kinge

[11] Patent Number: 6,052,270

[45] Date of Patent: Apr. 18, 2000

[54] IGNITION SYSTEM

[75] Inventor: Richard Arthur George Kinge, Bishops Tachbrook, United Kingdom

[73] Assignee: Smiths Industries Public Limited Company, London, United Kingdom

[21] Appl. No.: 09/118,907

[22] Filed: Jul. 20, 1998

[30] Foreign Application Priority Data

Aug. 1, 1997 [GB] United Kingdom ..... 9716318

[51] Int. Cl.[7] ..... F23Q 3/00

[52] U.S. Cl. ..... 361/253; 361/257

[58] Field of Search ..... 361/253–267

[56] References Cited

U.S. PATENT DOCUMENTS

| | | | |
|---|---|---|---|
| 3,894,273 | 7/1975 | Newport, Jr. et al. | 361/256 |
| 4,054,936 | 10/1977 | Ansai et al. | 361/257 |
| 4,261,025 | 4/1981 | Chafer et al. | 361/257 |
| 5,347,422 | 9/1994 | Smith et al. | 361/257 |
| 5,471,362 | 11/1995 | Gowan | 361/257 |
| 5,621,278 | 4/1997 | Chambers | 361/257 |

FOREIGN PATENT DOCUMENTS

| | | |
|---|---|---|
| 1517068 | 7/1978 | United Kingdom . |
| 95/13470 | 5/1995 | WIPO . |

*Primary Examiner*—Fritz Fleming
*Attorney, Agent, or Firm*—Pollock, Vande Sande & Amernick

[57] ABSTRACT

An ignition system has a first capacitor connected by a switch to the primary windings of a transformer. The secondary windings of the transformer are connected via a rectifier circuit to a second capacitor. An igniter is connected to the second capacitor by a cable that also has its own capacitance. In use, the combined charge on the second capacitor and the cable is gradually increased each time that the switch is closed and charge on the first capacitor is transferred to the transformer. The charge on the second capacitor and cable keeps increasing until it is sufficient to fire the igniter.

3 Claims, 1 Drawing Sheet

IGNITION SYSTEM

BACKGROUND OF THE INVENTION

This invention relates to ignition systems.

Conventional ignition systems employ a capacitor charged from a voltage source. When the charge on the capacitor has reached the necessary level, a switch is closed and the charge is applied to the primary windings of a transformer. The transformer acts to step up the voltage, the secondary windings being connected to a cable extending to an igniter mounted in a burner or the like. The igniter is often located some distance from the ignition system and is connected to it by a high voltage coaxial cable. Long cables of this kind act as transmission lines and seriously attenuate the fast pulses sent to the igniter electrodes. Furthermore, the charging of the self-capacitance of the cable absorbs much of the available energy and may result in insufficient energy at the igniter electrodes to produce reliable ignition.

SUMMARY OF THE INVENTION

It is an object of the present invention to provide an improved ignition system.

According to the present invention there is provided an ignition system which includes a first capacitor, means for charging the first capacitor, means for applying the voltage on the first capacitor to primary windings of a transformer, and means for charging a second capacitor from the voltage on the secondary windings of the transformer, the system is arranged so that the voltage on the second capacitor increases progressively each time the charge on the first capacitor is applied to the transformer until the charge on the second capacitor is sufficient to cause discharge at the igniter.

The means for applying the voltage on the first capacitor to the primary windings preferably includes a switch. The system preferably includes a cable having capacitance extending between the second capacitor and the igniter. The charge on the secondary winding is supplied to charge both the second capacitor and the capacitance of the cable. The ignition system preferably includes a rectifier circuit between the secondary windings and the second capacitor.

A conventional ignition system and one according to the present invention, will now be described, by way of example, with reference to the accompanying drawings.

DETAILED DESCRIPTION OF THE PRIOR ART

Figure 1:
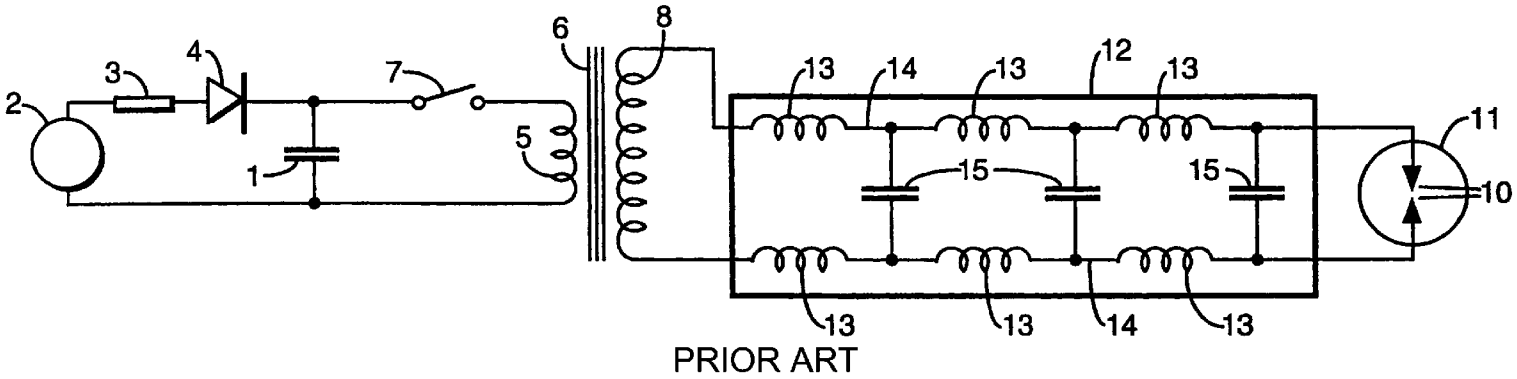
Fig.1. PRIOR ART
FIG. 1 is a circuit diagram of the conventional system.

With reference first to FIG. 1, the conventional system has a storage capacitor 1 connected across a voltage source 2 via a resistor 3 and a diode 4. Opposite plates of the capacitor 1 are connected across opposite ends of a primary winding 5 of a transformer 6 via a series-connected switch 7, which may be a mechanical or solid state switch, such as a thyristor. The secondary winding 8 of the transformer 6 is connected across the electrodes 10 of an igniter 11 via a coaxial cable 12. FIG. 1 shows the electrical equivalent circuit of the cable 12, which comprises three series-connected inductors 13 in both conductors 14, and three capacitors 15 connected in parallel between the two conductors at junctions between the inductors.

DETAILED DESCRIPTION OF THE PREFERRED EMBODIMENT OF THE INVENTION

Figure 2:
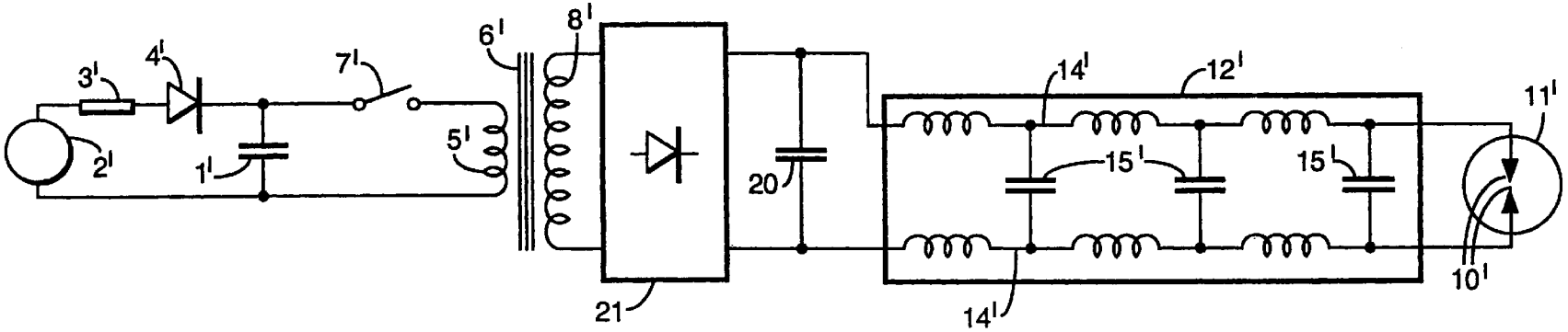
FIG. 2 is a circuit diagram of the system of the present invention.

With reference now to FIG. 2, there is shown an ignition system according to the present invention. Components in the circuit of FIG. 2 equivalent to those in FIG. 1 are given the same reference numeral with the addition of a prime '. That part of the system on the input/primary side of the transformer 6' is identical to that of FIG. 1, except that the capacitor 1' is generally smaller than that in the conventional system, so this part will not be described again here. The part of the system on the output/secondary side of the transformer 6' differs from the equivalent part in FIG. 1 in that a secondary capacitor 20 is connected across the secondary winding 8' via a rectifier circuit 21 and at the input end of the cable 12'. The rectifier circuit 21 is a half-wave device but could include a full-wave circuit so that it acts bidirectionally to recover more efficiently energy that may be lost in the "fly back" or ringing of the transformer 6'. The secondary capacitor 20 is connected across the two conductors 14' at the input of the cable 12'.

This circuit does not discharge sparks at the igniter 11' each time that the switch 7' is closed, but only after several cycles of charging and discharging the primary capacitor 1'. When the switch 7' is closed, energy is transferred to the secondary circuit of the transformer 6', as before, but the energy is applied across the secondary capacitor 20. The rectifier circuit 21 prevents the capacitor 20 discharging through the secondary windings 8' when the voltage across the windings drops, so the charge in the capacitor is built up each time the switch 7' is closed. As the voltage builds up on the capacitor 20 it also builds up on the distributed capacitance 15' in the cable 12', which effectively forms a part of the secondary capacitor. Fast voltage pulses no longer travel down the cable 12', so the available voltage is not attenuated. Each time that the switch 7' is closed, the voltage on the capacitance 20 and 15' of the secondary circuit will increase progressively. When this voltage exceeds the breakdown voltage of the igniter 11', the charge on the capacitances 20 and 15' is discharged across the igniter electrodes 10' to ignite the surrounding fuel/air mixture.

The system of the present invention gives a very reliable discharge of sparks at the end of a highly capacitive cable. It can be seen that the system progressively increases voltage until discharge occurs, in contrast with previous systems where the voltage applied is of a set value and may be insufficient to cause ignition in some circumstances. The present invention is, therefore, particularly useful for igniting fuel mixtures with a high dielectric strength, which are reluctant to ionize.

The circuit can be varied in various ways. For example, the primary circuit may be of various different kinds. Also, the secondary capacitor need not be located at the input end of the cable but could be located at some point along the cable, or at the igniter electrodes themselves.

What I claim is:

1. An ignition system comprising: a first capacitor; a circuit for charging said first capacitor; a transformer having a primary and a secondary winding; a circuit for applying a voltage on said first capacitor to said primary winding; a second capacitor; a circuit for charging said second capacitor from a voltage on said secondary winding; and a cable having capacitance, said cable extending between said second capacitor and an igniter so that the charge on the secondary winding is supplied to charge both said second capacitor and the capacitance of said cable at the same time, wherein the system is arranged so that combined charge on said second capacitor and the capacitance of said cable increases progressively each time the charge on said first capacitor is applied to said transformer until the combined charge on said second capacitor and said cable is sufficient to cause discharge at said igniter.

2. An ignition system according to claim 1, wherein said circuit for charging said capacitor is between said secondary winding and said second capacitor.

3. An ignition system comprising: a first capacitor; a circuit for charging the first capacitor; a transformer having a primary and a secondary winding; a switch circuit for applying a voltage on said first capacitor to said primary winding; a second capacitor; a rectifier circuit connected between said second capacitor and said secondary windings; an igniter; a cable having capacitance, said cable being connected between said igniter and said second capacitor, and wherein the combined voltage on said second capacitor and said cable increases progressively each time said switch circuit is closed until the combined charge on said second capacitor and said cable is sufficient to cause discharge at said igniter.

* * * * *